United States Patent [19]

Little

[11] Patent Number: 4,489,570

[45] Date of Patent: Dec. 25, 1984

[54] FAST COOLDOWN MINIATURE REFRIGERATORS

[75] Inventor: William A. Little, Palo Alto, Calif.

[73] Assignee: The Board of Trustees of the Leland Stanford Junior University, Stanford, Calif.

[21] Appl. No.: 562,214

[22] Filed: Dec. 16, 1983

Related U.S. Application Data

[63] Continuation of Ser. No. 445,852, Dec. 1, 1982, abandoned.

[51] Int. Cl.[3] ..... F25B 19/00

[52] U.S. Cl. ..... 62/514 R; 29/157.3 D; 165/168; 165/185

[58] Field of Search ..... 62/514 R; 165/168, 185; 29/157.3 D

[56] References Cited

U.S. PATENT DOCUMENTS 3,782,132 1/1974 Lohoff ..... 165/185

FOREIGN PATENT DOCUMENTS 2708270 8/1978 Fed. Rep. of Germany ..... 165/168
1439080 6/1976 United Kingdom ..... 156/633

*Primary Examiner*—Ronald C. Capossela
*Attorney, Agent, or Firm*—LeBlanc, Nolan, Shur & Nies

[57] ABSTRACT

A multilayer miniature low temperature rapid cooldown refrigerator in which a central cooling chamber for a device to be continuously cooled is connected to input and output refrigerant lines by micron sized channels formed in interfaces of glass or like plates, the channels including a counterflow heat exchanger and a capillary section and the channels being so arranged as to assure rapid cooldown immediately in the region of the device to be cooled.

7 Claims, 8 Drawing Figures

FAST COOLDOWN MINIATURE REFRIGERATORS

This is a continuation of application Ser. No. 445,852, filed Dec. 1, 1982, now abandoned.

This invention relates generally to refrigeration and more particularly to microminiature refrigerators which are generally of the type disclosed in copending applications Ser. Nos. 259,687; now abandoned 259,688 now U.S. Pat. No. 4,392,362 and 354,616 now U.S. Pat. No. 4,386,505.

As disclosed in greater detail in the above-identified applications the refrigerators with which the present invention is concerned are Joule-Thomson refrigerators formed by a laminate of plates which are etched to provide inflow and outflow gas channels which form a counterflow gas heat exchanger, a capillary section, a boiler region and the interconnecting passages between these sections. Refrigerators of this type have particular utility in providing extremely low temperature cooling for chips or superconductor devices which are generally of small dimension, for example, a centimeter square.

The refrigerators disclosed in the aforementioned copending applications were developed for maximum efficiency in order to minimize gas flow rates required for various refrigeration capacities. There are, however, a number of cooling applications which can tolerate higher gas flow rates to achieve the primary objective of rapid cooldown. Such applications include cooling infra red detectors in tactical missiles and precision guided munitions. Fast cooldown devices might also be used to cool sensitive detectors and low noise amplifiers in scientific instruments which are operated infrequently and for relatively short durations.

The principal purpose of the present invention is to provide improved microminiature refrigerators of the type described which answer these requirements by providing extremely rapid cooldown.

It has been discovered that the limiting factor in rapid cooldown applications is the amount of heat which must be extracted from the material being cooled including the material in the refrigerator itself. In accordance with the present invention novel arrangements, configurations and relationships of the inflow and outflow passages provide for maximum cooling at a small localized area of the refrigerator.

It is a further object of the invention to provide improved microminiature refrigerators which will withstand the high vibration and acceleration forces which occur during launch of missiles and similar munitions.

It is a further object of the present invention to provide rapid cooldown microminiature refrigerators which can be packaged with the device to be cooled in small low cost hermetically sealed packages with internal cavities that may be evacuated or backfilled with an inert gas.

It is a further object of the present invention to provide improved fast cooldown microminiature refrigerators which may be operated in normal atmosphere conditions.

Additional objects and advantages of the present invention will become apparent as the description proceeds in connection with the accompanying drawings in which.

DESCRIPTION OF THE PREFERRED EMBODIMENTS

Figure 1:
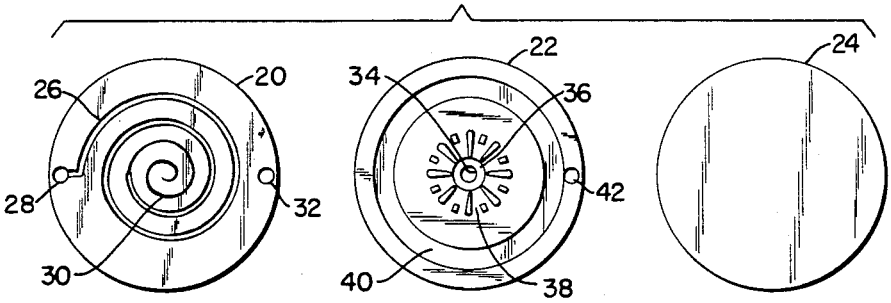
FIG. 1 is an exploded view of three plates which comprise the major components of the refrigerator of the present invention prior to assembly.
Figure 2:
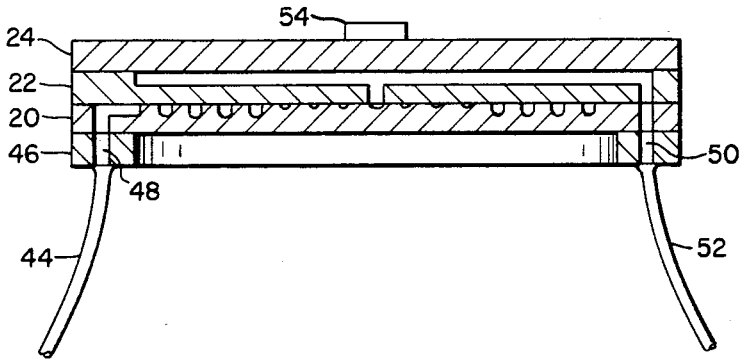
FIG. 2 is a central transverse section through a refrigerator formed by the assembly of the components of FIG. 1.

Referring now more particularly to the drawings and especially to FIGS. 1 and 2 the principal components of the refrigerator there shown are three circular plates 20, 22 and 24 of glass or similar materials of low thermal conductivity having the same coefficient of thermal expansion.

Etched on the upper surface of the plate 20 is an inflow channel 26 of spiral form leading from a through input port 28 to a central spiral capillary channel 30. The plate 20 is also provided with a through output port 32.

The plate 22 is provided with a central through opening 34, the upper end of which opens into a circular recess 36 in communication with a series of radial channels 38, the outer ends of which are in communication with an annular channel 40 leading to an output port 42.

The plate 24, which functions as the top cover plate, has planar top and bottom surfaces.

The plates 20, 22 and 24 are assembled to form the refrigerator as shown in FIG. 2, with the plate 22 overlying the plate 20 and the plate 24 overlying the plate 22.

In a typical case the plates 20, 24 are 0.7 inches in diameter and each approximately 0.010 inches thick. Typically the inflow channel 26 is 0.002 inches wide and about the same in depth. The capillary channel 30 is typically about 0.002 inches wide and about 0.00075 inches deep. The other channels and ports are correspondingly dimensioned.

These channels and ports in the plates 20 and 22 are preferably formed in the manner disclosed in detail in the aforesaid copending applications and the plates 20, 22 and 24 are sealingly assembled in face-to-face contact also by the methods disclosed in these applications.

Gaseous refrigerant is supplied to the unit through an inlet tube 44 brazed or otherwise sealingly secured to a ring 46 sealingly secured to the undersurface of the plate 20 to dispose a through port 48 in alignment with the inlet port 28. The ring 46 also includes an outlet port 50 disposed in alignment with outlet ports 32 and 42 in the plates 20 and 22, the port 50 leading to a suitable outlet tube 52.

In operation, suitable gas, such as nitrogen, is supplied to the inlet tube 44 at pressure in the range of 6,000 psi. The compressed nitrogen passes through the inflow channel 26 to the capillary channel 30 which substantially reduces the pressure of the gas and produces the desired cooling, maximum cooling being effected in the region of the port 34 and the recess 36 which is located immediately beneath the device 54 to be cooled which is mounted centrally on the upper surface of the plate 24. The cooled gas then passes through the radial channels 38 in heat exchange relation with the incoming gas passing through the channel 26 and the capillary channel 30 to precool the incoming gas, further accelerating the cooldown rate. The gas then exits from the device to any convenient point of disposal.

The unit is effective to produce a temperature of 90° Kelvin in a few seconds after start-up, this temperature being achieved in the region of the port 34 and the recess 36, which, as noted above, is in the immediate region of the device 54 to be cooled. A wide range of compressed gases can be used to achieve different cooldown rates for a range of minimum temperatures.

Figure 3:
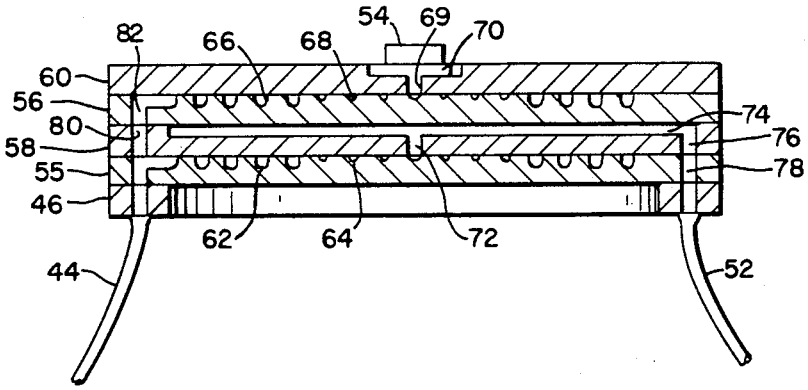
FIGS. 3, 4 and 5 are views similar to FIG. 2 showing further embodiments of the present invention.

In the modified form of the invention shown in FIG. 3 the unit includes plates 55 and 56 similar to the plate 20, a plate 58 similar to the plate 22 and a modified top plate 60.

As in the previously described embodiment the plate 55 has a spirally arranged inflow passage 62 connected to a capillary section 64 and the plate 56 has a similar inflow passage 66 and capillary passage 68. The top plate 60 has a central through opening 69 which is vented to atmosphere through a series of radial channels 70 positioned immediately beneath the device 54.

In operation, gas flows from the inlet tube 44 through the passages 62 and 64 to a central port 72 in the plate 58 thence through radial channels 74 for exit from the device through the aligned outlet ports 76 and 78, thus cooling the central portion of the refrigerator unit. Additionally, a portion of the gas passes through aligned ports 80 and 82 in the plates 58 and 56 for passage through the channels 66 and 68 for subsequent passage to the atmosphere directly through the port 69 and the channels 70.

Since the pressure of the gas as it leaves the capillary section 68 determines the minimum operating temperature of the refrigerator this embodiment of invention achieves the lowest possible operating temperature in the region of device 54.

Figure 4:
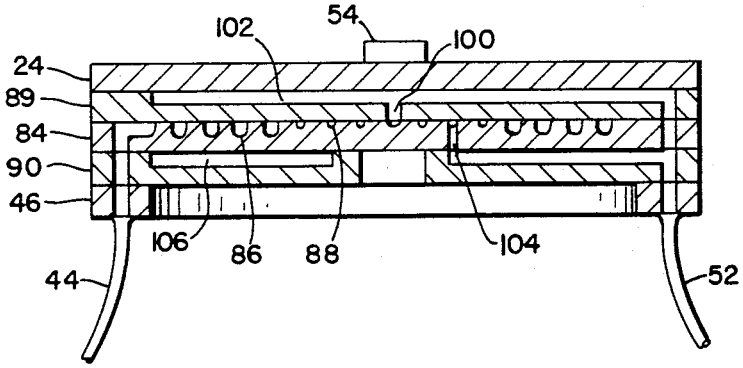

The embodiment of FIG. 4 comprises a plate 84 similar to the plate 20 having a spiral inflow passage 86 and a capillary section 88, a top panel 24, a modified intermediate plate 89 and a bottom plate 90.

In operation, gas under pressure is supplied through suitable ports to the inflow channel 86, a portion of the gas then passing through capillary section 88 thence through a central port 100 and radial channels 102 for passage through aligned outlet ports to the outlet tube 52. Additionally, a portion of the gas entering the capillary section 88 is tapped off through a port 104 for passage through a relatively wide annular channel 106 to the exterior of the device. In this embodiment of the invention the incoming gas in the channel 86 is effectively precooled by its passage in heat exchange relation with the cooled gas passing through the radial channels 102 and the annular channel 106.

Figure 5:
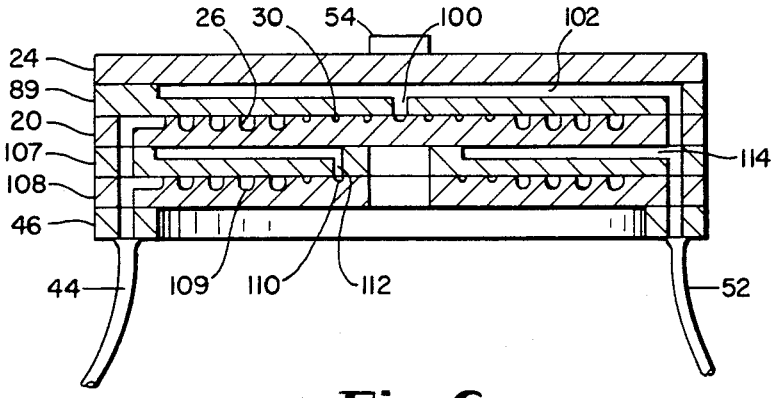

The embodiment of FIG. 5 is similar to the embodiment of FIG. 4 and includes an additional plate to provide for additional precooling of the incoming gas. More specifically, the unit of FIG. 5 includes a top plate 24, an intermediate plate 89, a central plate 20 and lower plates 107 and 108, the latter having an inflow section 109 and a capillary section 110. The operation of the device in FIG. 5 is essentially the same as that of FIG. 4 except that a portion of the gas is delivered through the alternate inflow passage 109 and the capillary passage 110 for passage through a port 112 to radial channels 114 formed in the upper surface of plate 107 thence to the exterior of the device. This embodiment of the invention thus provides additional precooling for the incoming gas to assure rapid cooldown.

As previously noted, all embodiments of the invention employ the same concept of cooling the central portion of the refrigerator in order to minimize the amount of material being cooled. This creates a large temperature gradient from the center of the refrigerator to its outside edge which remain at least initially at ambient temperatures. This temperature gradient may produce severe stress in the refrigerator plates as the cooled central material attempts to contract while the warmer outer areas resist this contraction.

Figure 6:
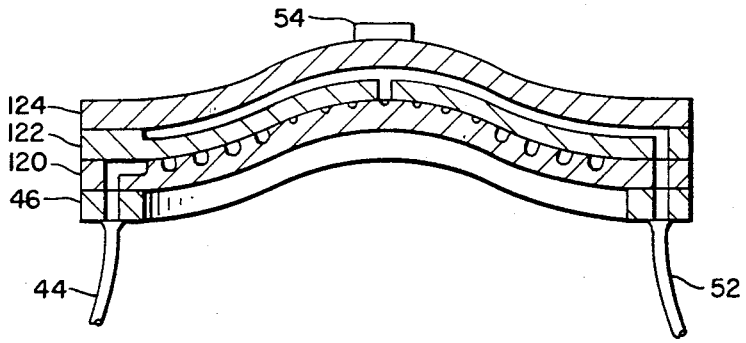
FIG. 6 is a view similar to FIG. 2 illustrating a further embodiment of the invention which reduces thermal stress induced in the device during cooling.

FIG. 6 illustrates a further form of the invention incorporating a unique configuration to eliminate the adverse effects of thermal stress. The refrigerator of FIG. 6 comprises three plates 120, 122 and 124 which are identical to the previously described plates 20, 22 and 24 except that the plates, at least in their central region, are upwardly convex. This configuration enables the material in the cooled central region of the refrigerator to contract without inducing stress in the outer region.

As noted above the refrigerators of the present invention may readily be incorporated in a hermetically sealed unit where desired.

Figure 7:
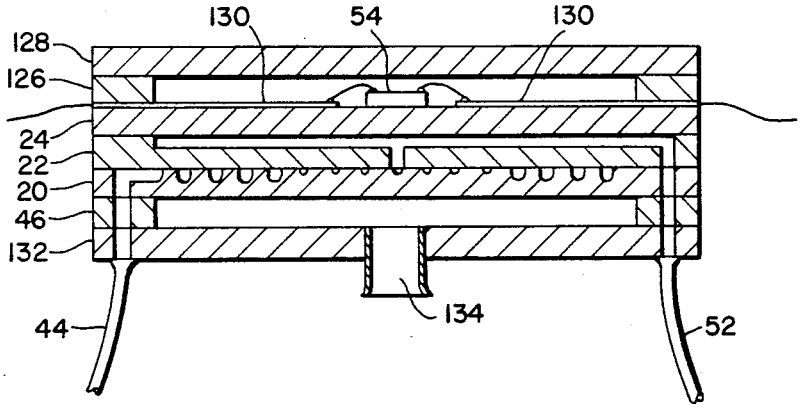
FIGS. 7 and 8 are central transverse sections illustrating alternate constructions for hermetically packaging the refrigerators of the present invention.

For example, as shown in FIG. 7 an upper ring 126 sealingly secured to the upper surface of the plate 24 carries a top cover plate 128 to form a sealed space about the device 54. Electrical leads 130 are printed or similarly deposited on the upper surface of the plate 24 and lead to the exterior of the device. Similarly a bottom cover plate 132 is sealingly secured to the lower surface of the ring 46 to complete the incapsulation of the entire refrigerator. The bottom plate 132 is provided with a port 134 which permits the interior of the device to be evacuated or to be filled with an inert gas as desired.

Figure 8:
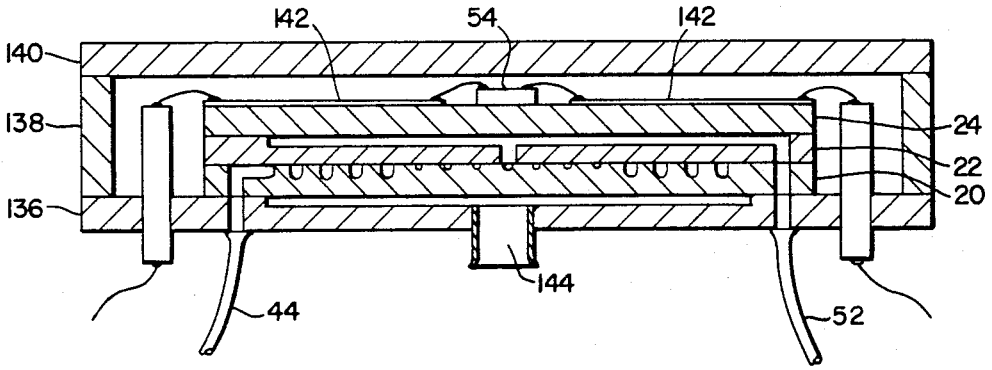

In the embodiment of FIG. 8 a suitably apertured bottom cover plate 136 is sealingly secured to the lower surface of the plate 20 in lieu of the ring 46 previously described. The sealed housing for the unit of FIG. 8 is completed by an annular wall member 138 and a top cover member 140 suitably sealingly secured together. The electrical leads 142 for the device 54 may be conducted to the exterior of the housing through the bottom wall 136 as shown. As in the previously described embodiment the bottom cover member 136 may be ported as at 144 to permit the interior of the device to be evacuated or supplied with an inert gas.

In each of the embodiments of FIGS. 7 and 8 the refrigerators per se are supported around their outside perimeters which results in a rigid structure capable of withstanding the high vibration and shock forces which exist during the launch of tactical missiles and precision guided munitions.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A microminiature cryogenic refrigerator for cooling superconductor devices and the like comprising at least three plates of material of low like material of low thermal conductivity bonded together in pressure tight contact over an interface area to provide a stiff laminate, said plates having a central region and a peripheral region, an outermost one of said plates being adapted to carry a device to be cooled adjacent its central region, means forming a low temperature chamber at said central region of said laminate, means forming a micron sized supply fluid passage in the interface area between two of said plates connecting an input fluid port to said low temperature chamber, said supply passage comprising a first section for conducting incoming highly compressed gas and a serially connected smaller diameter second capillary section opening into said low temperature chamber, said supply passage being of spiral configuration, and means forming outflow passages in another interface between two of said plates, said outflow passages extending radially from said low temperature chamber to an exit port adjacent the periphery of said refrigerator whereby the cooled gas flowing through said outflow passages is disposed in heat exchange relation with the incoming gas passing through said supply passage to effectively precool the gas passing through said supply passage.

2. The refrigerator according to claim 1 together with an additional plate, means forming a second supply passage in the interface between said additional plate and an adjacent plate, said additional supply passage being connected in parallel with said first mentioned supply passage and including a spirally arranged supply section serially connected to a spirally arranged smaller diameter capillary section, and means connecting the outlet end of said capillary section of said additional supply passage to conduct the cooled gas exiting therefrom to the exterior of the device in the region of the device to be cooled.

3. The refrigerator according to claim 1 together with additional passage means for conducting a portion of the gas delivered to said capillary section to the exterior of said device in heat exchange relation with the incoming gas passing through said supply passage.

4. The refrigerator according to claim 1 wherein said plates are circular in form and are upwardly convex in their central region.

5. The refrigerator according to claim 1 together with means forming a hermetically sealed housing enclosing said refrigerator.

6. The refrigerator according to claim 5 wherein said housing is provided with a port by which the housing may be evacuated or supplied with an inert gas.

7. The refrigerator according to claim 5 wherein said housing is directly secured to said refrigerator at a peripheral region thereof to provide structural support for said refrigerator.

* * * * *

UNITED STATES PATENT AND TRADEMARK OFFICE

CERTIFICATE OF CORRECTION

PATENT NO. : 4,489,570

DATED : December 25, 1984

INVENTOR(S) : William A. Little

It is certified that error appears in the above-identified patent and that said Letters Patent is hereby corrected as shown below:

Column 5, line 3, delete "material of low" (both occurrences).

Signed and Sealed this

*Twenty-fifth* Day of *June 1985*

[SEAL]

*Attest:*

DONALD J. QUIGG

*Attesting Officer* *Acting Commissioner of Patents and Trademarks*